US006990389B2

(12) United States Patent
Sasaki

(10) Patent No.: US 6,990,389 B2
(45) Date of Patent: Jan. 24, 2006

(54) METHOD OF PREDICTING DRYER STEAM PRESSURE IN PAPER MACHINE AND APPARATUS FOR THE METHOD

(75) Inventor: Takashi Sasaki, Musashino (JP)

(73) Assignee: Yokogawa Electric Corporation, Tokyo (JP)

( * ) Notice: Subject to any disclaimer, the term of this patent is extended or adjusted under 35 U.S.C. 154(b) by 500 days.

(21) Appl. No.: 10/378,770

(22) Filed: Mar. 4, 2003

(65) Prior Publication Data

US 2004/0002786 A1 Jan. 1, 2004

(30) Foreign Application Priority Data

Jun. 27, 2002 (JP) ..... 2002-187160

(51) Int. Cl.
*C06F 7/66* (2006.01)
*D21F 5/06* (2006.01)

(52) U.S. Cl. ..... 700/128; 34/568; 162/263

(58) Field of Classification Search ..... 700/127, 700/128; 34/527, 528, 568; 162/198, 263, 162/252

See application file for complete search history.

(56) References Cited

U.S. PATENT DOCUMENTS 4,836,894 A * 6/1989 Chance et al. ..... 162/253
5,718,060 A * 2/1998 Mori ..... 34/446
5,862,613 A * 1/1999 Kerttula et al. ..... 34/446
6,446,356 B1 * 9/2002 Hamstrom et al. ..... 34/451
6,780,284 B2 * 8/2004 Almi et al. ..... 162/198
6,904,331 B2 * 6/2005 Sasaki et al. ..... 700/128

* cited by examiner

*Primary Examiner*—Leo Picard
*Assistant Examiner*—Sheela S. Rao

(57) ABSTRACT

The present invention relates to an algorithm used in a method and apparatus for controlling a paper machine, in order to automatically tune parameters used to calculate the initial value of web moisture percentage at a dryer part inlet after grade change and parameters used to calculate the dry-bulb temperature of air within a hood.

In the method and apparatus, a regression line correlating the ratio of a difference in bone dry basis weight before and after grade change with a difference between the predicted value and steady-state value of steam pressure is determined from a plurality of point-of-grade-change data items, and a first parameter is calculated from the slope of this regression line.

With the method and apparatus of the present invention, it is possible to automatically determine the value of the first parameter using earlier point-of-grade-change data, which used to be determined empirically. It is also possible to obtain parameter values in which the intrinsic properties of the paper machine in question are factored, by determining a regression line and calculating the values of parameters best suited to earlier data.

25 Claims, 7 Drawing Sheets

METHOD OF PREDICTING DRYER STEAM PRESSURE IN PAPER MACHINE AND APPARATUS FOR THE METHOD

BACKGROUND OF THE INVENTION

1. Field of the Invention

The present invention relates to an algorithm used in a method of controlling a paper machine to automatically tune parameters for calculating the initial value of web moisture percentage at a dryer part inlet after grade change and parameters for calculating the dry-bulb temperature of air within a hood. The invention also relates to apparatus for implementing such an algorithm.

2. Description of the Prior Art

In the specification of Patent Application 2001-106038, the applicant proposed equation (1) shown below as an equation for calculating the initial value of a web's dryer part inlet moisture percentage after grade change.

$$\text{Initial value of web's moisture percentage} = MPNowInit + A_1 \times \frac{BD_2 - BD_1}{BD_1} + A_2 \times \frac{V_2 - V_1}{V_1} \quad (1)$$

where $BD_1$: Bone dry basis weight before grade change (g/m$^2$)

$BD_2$: Bone dry basis weight setpoint after grade change (g/m$^2$)

$V_1$: Machine speed before grade change (m/min)

$V_2$: Machine speed setpoint after grade change (m/min)

MPNowInit: 50% (fixed)

$A_1$, $A_2$: Tuning parameters

Also in the specification of Patent Application 2001-014493, the applicant proposed equation (2) shown below as an equation for calculating the dry-bulb temperature of air within a hood.

$$\text{Dry-bulb temperature } T_a(j) = A_3 \times (T_s(j) - T_s Init(j)) + T_a Init(j) \quad (j = 1, \ldots, N) \quad (2)$$

where $T_s(j)$: Steam pressure within drum $T_s$Init(j): Initial value of steam pressure within drum $T_a$Init(j): Initial value of dry-bulb temperature of air within hood N: Number of mesh divisions j: Mesh division number $A_3$: Parameter

SUMMARY OF THE INVENTION

However, such a method of predictive dryer control in a paper machine as described above has had the following problems.

Parameters $A_1$, $A_2$ and $A_3$ in equations (1) and (2) shown above were determined manually and empirically using earlier point-of-grade-change data. This way of determining the parameters was problematic, as it required experience. Another problem was that the quality of paper, which is a product, varies since precise tuning was not possible.

The object of the present invention is therefore to provide a method of predictive dryer control in a paper machine whereby parameters can be tuned automatically, and to provide apparatus for the method.

DETAILED DESCRIPTION OF THE PREFERRED EMBODIMENTS

Preferred embodiments of the present invention will now be described in detail by referring to the accompanying drawings.

Figure 1:
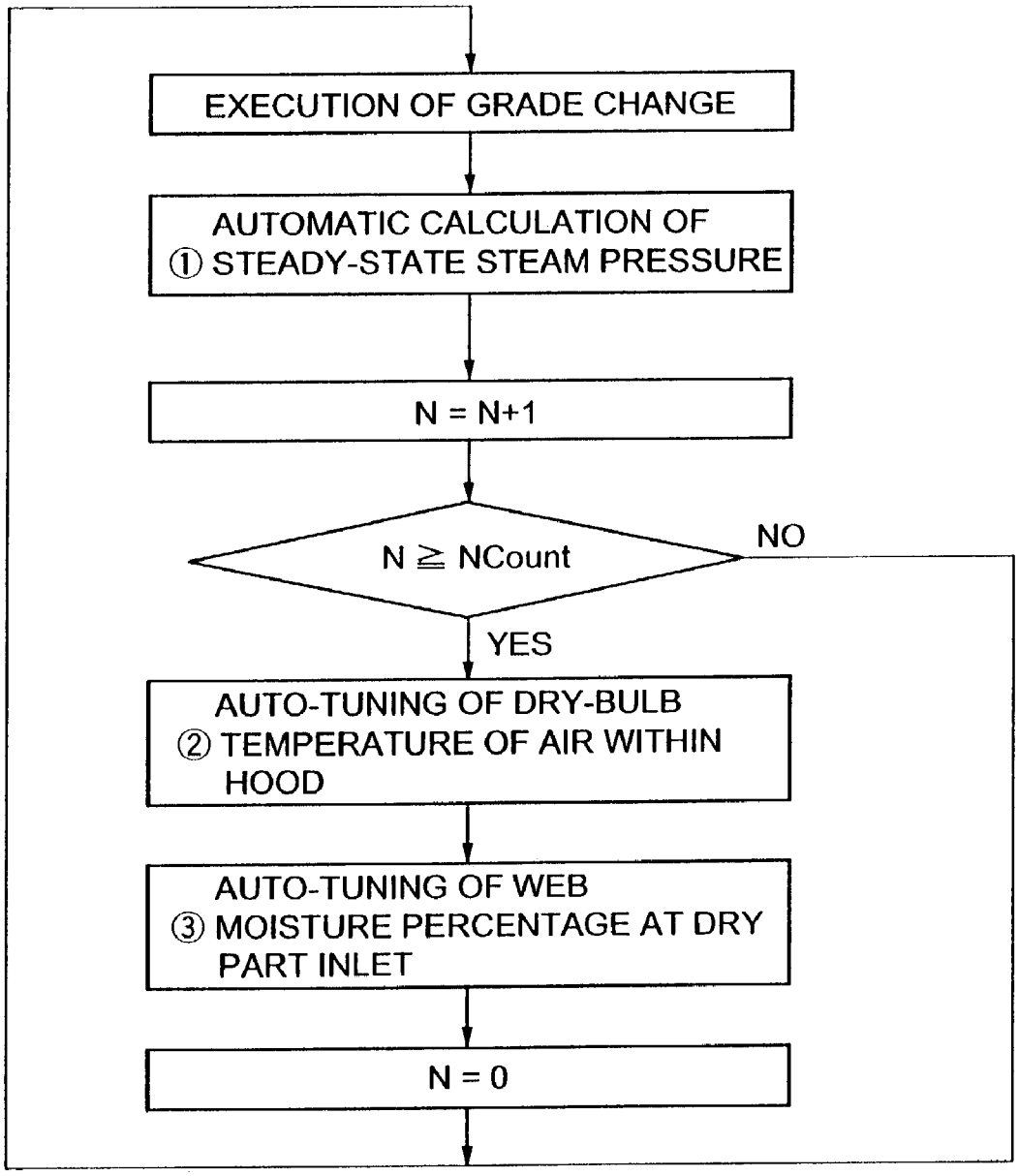
FIG. 1 is a flowchart showing one embodiment of the present invention.

FIG. 1 is a flowchart showing one embodiment of a method of predictive dryer control in a paper machine according to the present invention. In FIG. 1, each time a grade change is made, the automatic calculation of steady-state steam pressure indicated by ① is performed. Specifically, the steady-state value of steam pressure is automatically calculated from steam pressure trend data after grade change, and the results of calculation are saved in a file. Then, counter N is incremented.

When counter N reaches or exceeds the predetermined value NCount, auto-tuning calculation is performed. NCount is set to, for example, 10. Auto-tuning is classified into two types: auto-tuning of the dry-bulb temperature of air within a hood as indicated by ② and auto-tuning of a web's moisture percentage (MP) at the dry part inlet as indicated by ③.

Firstly, the dry-bulb temperature of air within a hood is auto-tuned as indicated by ②. The steady-state values of steam pressure stored in the step indicated by ① are read. Then, differences between the predicted values of steam pressure in grade change involving relatively large production volume changes and the steady-state values of steam pressure that have been read are determined. An average ratio of these differences to the amounts of change in the production volume is calculated. According to this ratio, parameter $A_3$ to be used in an equation for calculating the dry-bulb temperature of air within the hood is auto-tuned.

Secondly, the web moisture percentage (MP) at the dry part inlet is auto-tuned as indicated by ③. To do this, the steady-state values of steam pressure stored in the step indicated by ① are read. Then, differences between the predicted values of steam pressure in; grade change involving relatively small production volume changes and the steady-state values of steam pressure that have been read are determined.

An average ratio of these differences to the amounts of basis weight change at grade change and an average ratio of the differences to the amounts of machine speed change are determined. According to these ratios, parameters $A_1$ and $A_2$ to be used in an equation for calculating the web moisture percentage (MP) at the dry part inlet are auto-tuned.

Calculation of the predicted values of steam pressure is influenced by the auto-tuning of parameters $A_1$ and $A_2$ in grade change involving relatively large production volume changes. In order to cancel this influence, parameter $A_3$ that is used to calculate the dry-bulb temperature of air within the hood is also auto-tuned. When these two types of auto-tuning are completed, counter N is cleared to zero.

Now, these steps will be explained in detail. Firstly, the automatic calculation of the steady-state values of steam pressure indicated by ① will be explained.

In order to determine the steady-state values of steam pressure, the process values of pre-dryer steam pressure are first measured at 30-second intervals after grade change and saved in a file. The time interval from the point StartTime (minute) to the point EndTime (minute) during which the steam pressure is relatively stable is defined as the steady-state value calculation interval. At each time point during that interval, the standard deviation of steam pressure process values in the immediately preceding AveTime (minutes) duration is determined. The value of the AveTime duration may be defined appropriately, depending on the process under consideration.

The standard deviation is calculated by the following steps. Assume that the process value of steam pressure i/2 minutes after grade change is SteamP(i) (i=0 . . . EndTime×2). The reason for dividing i by 2 is that measurements are taken at 30-second intervals.

Given that NAve=2×AveTime, i=2×StartTime, . . . 2×EndTime, the following equations hold true.

$$AveSteamP(i) = \frac{1}{NAve} \cdot \sum_{j=1}^{NAve} SteamP(i+1-j) \tag{3}$$

$$SigmaSteamP(i) = \sqrt{\frac{1}{NAve} \sum_{j=1}^{NAve} (SteamP(i+1-j) - AveSteamP(i))^2} \tag{4}$$

where, AveSteamP(i) is the average value (kPa) of pre-dryer steam pressure in the immediately preceding AveTime (minutes) duration as measured i/2 minutes after the end of grade change; and SigmaSteamP(i) is the standard deviation (kPa) of pre-dryer steam pressure in the immediately preceding AveTime (minutes) duration also as measured i/2 minutes after the end of grade change.

In the next step, the time point at which the standard deviation of steam pressure process values evaluated by equation (4) above is minimum is determined. Then, the average value of steady-state steam pressure in the AveTime duration immediately preceding that time point is defined as the steady-state steam pressure value (StableP). However, if this minimum value of standard deviation is greater than that of a given unsteady-state region (UnstableValue), the steady-state steam pressure value is set to 0, concluding that the process did not stabilize.

This procedure can be described in a program format, as shown below.

```
imp = {Value of I that causes SigmaSteamP(i) to become
    minimum | 2 × StartTime ≦ I ≦ 2 × EndTime}
If SigmaSteamP(imp) < UnstableValue
    StableP = AveSteamP(imp)
Else
    StableP = 0
Endif
```

Figure 2:
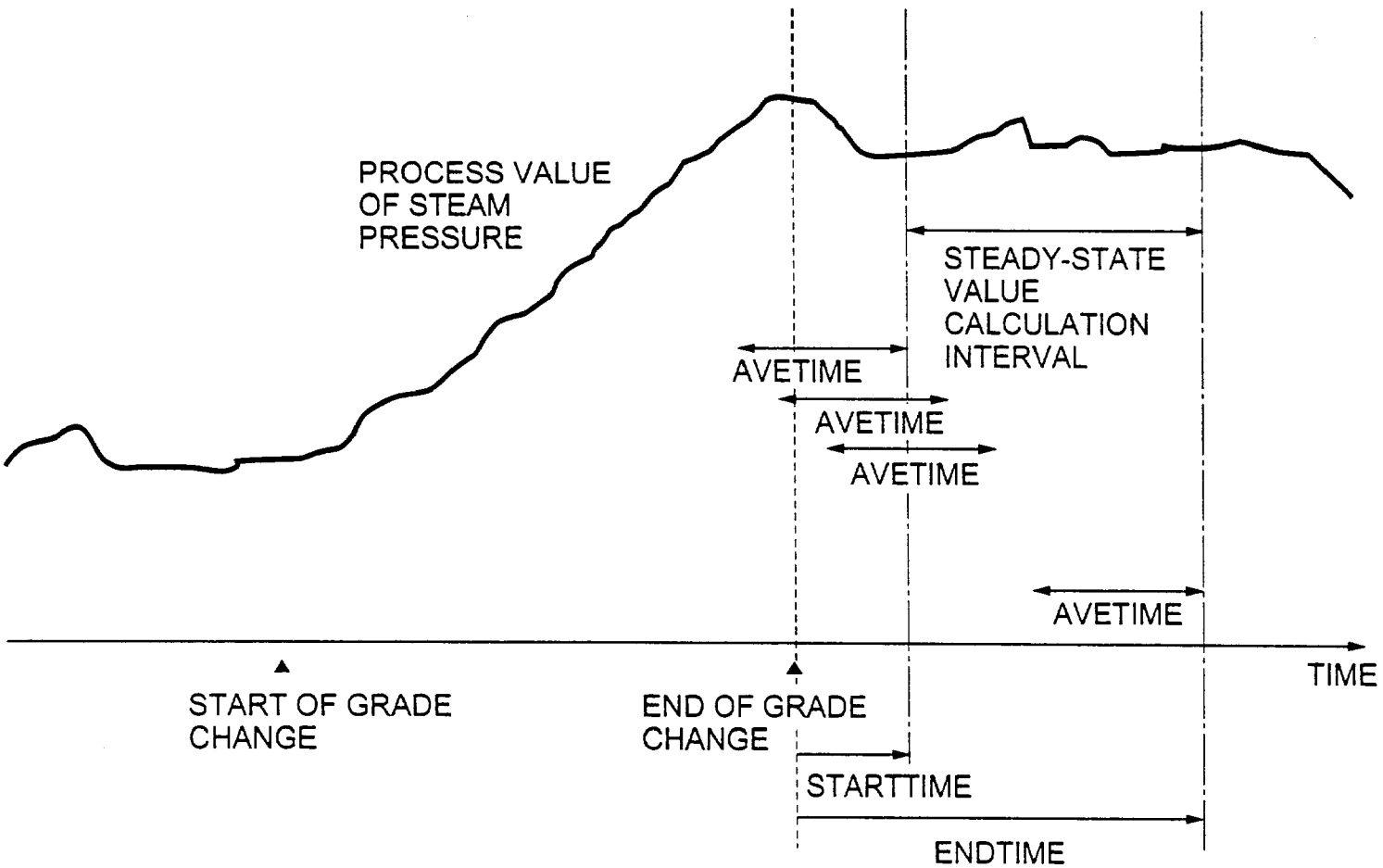
FIG. 2 is a characteristic graph explaining the procedure of calculating the standard deviation of steam pressure.

FIG. 2 is a graphical representation of the aforementioned way of calculating steady-state steam pressure values. The vertical axis denotes the process value of steam pressure and the horizontal axis represents time. When grade change is initiated, the process value of steam pressure increases; when grade change is completed, the value ceases to increase and begins to decrease. In addition, the process value of steam pressure is measured at 30-second intervals from the moment grade change is completed and saved in a file.

The interval from the moment StartTime has elapsed to the moment EndTime has elapsed after the completion of grade change is defined as the steady-state value calculation interval. In this interval, the standard deviation of steam pressure process values is calculated. Specifically, from equations (3) and (4) above, the standard deviation of steam pressure process values in the immediately preceding AveTime duration is determined at 30-second intervals. The range labeled AveTime and indicated by each double arrow in FIG. 2 is the interval in which a standard deviation is determined. In addition, the average value of steam pressure in the AveTime duration immediately preceding the time point at which the standard deviation is minimum is determined as the steady-state steam pressure value (StableP).

Now, an explanation will be made of the auto-tuning of dry-bulb temperature of air within a hood. The dry-bulb temperature of air within a hood before and after grade change varies depending on the steam temperature values before and after grade change since, in practice, the air is trapped within a hermetically sealed dryer hood. The mechanisms of air supply/exhaust of a dryer hood and of heat transfer to the outside air are so complex, however, that it is difficult to simulate the process of such air supply/exhaust or heat transfer.

For this reason, in the specification of Patent Application 2001-014493 the applicant proposed equation (2), as discussed earlier, as a simple linear equation for calculating the dry-bulb temperature of air within a hood. It was not possible however to theoretically determine which value of coefficient $A_3$ in the equation, among those between 0.0 and 1.0, should be applied; rather, the value had to be determined empirically. In this embodiment, the value of coefficient $A_3$ is recursively determined from errors in the predicted value of steam pressure.

As is evident from equation (2), the dry-bulb air temperature within a hood increases as the change in the steam pressure before and after grade change becomes greater. Therefore, as data to be used to tune coefficient $A_3$, only the data on such instances of grade change that involves production volume changes greater than a given value is used.

For this purpose, instances of grade change that satisfy condition equation (5) below are exclusively selected.

$$\text{Condition:}\left(\frac{abs(R_2 - R_1)}{R_1} \geq \Delta RAna\right) \& \left(\frac{abs(BD_2 - BD_1)}{BD_1} \geq \Delta BDAna\right) \& \ (StableP \neq 0) \tag{5}$$

where $R_1$: Production volume before grade change ($g/m^2 \times m/min$)

$R_2$: Production volume after grade change ($g/m^2 \times m/min$)

ΔRAna: Point-of-production-change ratio $BD_1$: Bone dry basis weight before grade change ($g/m^2$)

$BD_2$: Bone dry basis weight setpoint after grade change ($g/m^2$)

ΔBDAna: Minimum basis weight change ratio

The first term of equation (5) indicates that the ratio of change in the production volume before and after grade change is greater than the point-of-production-change ratio ΔRAna. Note that production volumes $R_1$ and $R_2$ referred to here are represented by the product of bone dry basis weight and machine speed with no regard to the paper width. Specifically, the production volumes are defined as $$R_1=BD_1\times V_1(\text{g/m}^2\times\text{m/min})$$

$$R_2=BD_2\times V_2(\text{g/m}^2\times\text{m/min})$$

$V_1$ and $V_2$ are machine speeds before and after grade change, respectively.

The second term of equation (5) indicates that the ratio of basis weight change before and after grade change is greater than the minimum basis weight change ratio $_{\Delta}$BDAna. If the basis weight change is marginally small, predicting the steam pressure is theoretically easy and will not produce any errors in principle. Therefore, instances of grade change involving only small basis weight changes are excluded from the evaluation of predicted errors. The third term of equation (5) indicates that the process has stabilized after grade change and the steady-state values of steam pressure have been successfully calculated.

In the next step, a scatter diagram is created by plotting the predicted steam pressure error as the ordinate and the production volume change as the abscissa and retroactively applying NGC1 data items of grade change instances, among those that meet the condition given by equation (5). Then, according to equation (6) below, the slope of the regression line in the scatter diagram is determined by the least squares method. NGC1 is set to, for example, 50.

By applying symbols used in equation (5), the X and Y coordinates $X_R$ and Y of an ith data item are represented as $$X_R(i)=(R_2(i)-R_1(i))/R_1(i)$$

$$Y(i)=(\text{Predicted pre-dryer steam pressure}(i))-\text{Stable}P(i)$$

StableP is the steady-state steam pressure determined in the step of automatically calculating steady-state steam pressure values.

From $X_R$(i) and Y(i), the slope $K_R$ of the regression line can be determined by using equation (6) below.

$$K_R=\frac{\sum_{i=1}^{MGCI} X_R(i)\times Y(i)}{\sum_{i=1}^{NGCI} X_R(i)^2} \tag{6}$$

Using the slope $K_R$, parameter $A_3$ is tuned. Specifically, if the absolute value of $K_R$ is smaller than the threshold $TH_{PreA3}$, parameter $A_3$ is not changed in order to avoid excessive change. If the absolute value of $K_R$ is larger than the threshold $TH_{PreA3}$, $K_R$ is increased by multiplying it by a weighting factor.

As $A_3$ increases, the dry-bulb temperature of air within a hood rises at a higher rate in response to an increase in the steam pressure. Consequently, calculating the predicted steam pressure results in a value lower than the current one. This problem can be solved, however, by applying a positive value to the weighting factor, or by increasing $A_3$ if $K_R$ is positive. Since in theory, any rise in the temperature of air within a hood never exceeds an increase in the steam temperature, $0.0\leqq A_3\leqq 1.0$ holds true. Consequently, specific upper and lower limits are provided so that this relationship is satisfied.

This process of tuning $A_3$ can be described in a program format, as shown below.

If abs($K_R$)$\geqq TH_{PreA3}$ then $$A_{3,\ New}=F_{A3}\times K_R+A_{3,\ Old} \tag{7}$$

If $A_{3,\ New}>AHI_3$ then $A_{3,\ New}=AHI_3$

If $A_{3,\ New}<ALO_3$ then $A_{3,\ New}=ALO_3$ where, $TH_{PreA3}$ is a threshold, $F_{A3}$ is a weighting factor, $AHI_3$ is an upper limit, and $ALO_3$ is a lower limit. Parameter $A_3$ with a subscript containing the word "New" is a newly calculated value, whereas that with a subscript containing the word "Old" is a previous value. $F_{A3}$, $AHI_3$ and $ALO_3$ are set from the screen of a control unit in the paper machine.

Now, an explanation will be made of the auto-tuning of web moisture percentage (MP) at the dryer part inlet. Some instances of grade change may involve a large change in the production volume. In other instances, however, the amount of change in the production volume as represented by a product of basis weight and machine speed often proves small, though changes in the basis weight and machine speed are significantly large.

For example, assume that bone dry basis weight before grade change=80 (g/m$^2$), bone dry basis weight after grade change=100 (g/m$^2$), machine speed before grade change=700 (m/min), and machine speed after grade change=560 (m/min). This would result in a large-scale grade change since changes in the basis weight and machine speed are significantly large. In fact, however, the production volume (basis weight$_{\times}$machine speed) does not change.

In this case, a change in the steam pressure is relatively small. Accordingly, the calculation of equation (2) as to the dry-bulb temperature of air within a hood does not significantly affect the predicted steam pressure. In contrast, the calculation of equation (1) as to the web moisture percentage (MP) at the dryer part inlet significantly affects the predicted steam pressure.

Accordingly, in order to increase the accuracy of predicted steam pressure in the case of grade change involving only small production volume changes, it is necessary to use a method contrary to the method of parameter tuning discussed earlier in the auto-tuning of the dry-bulb temperature of air within a hood. That is, parameters $A_1$ and $A_2$ should be tuned using data on instances of grade change involving production volume changes smaller than a prescribed-value.

For this reason, condition expression (8) below is used in place of equation (5).

$$\text{Condition:}\left(\frac{abs(R_2-R_1)}{R_1}<\Delta RAna\right)\ \&\ \left(\frac{abs(BD_2-BD_1)}{BD_1}\geq\Delta BDAna\right)\ \&\ (StableP\neq 0) \tag{8}$$

The meanings of symbols in this expression are the same as those in condition expression (5) and so are not explained here. The first term of this expression indicates that the amount of change in the production volume is small. The meanings of the second and third terms are the same as those of equation (5) and so are not explained here.

Using retroactive NGC2 data items on the instances of grade change, among those that satisfy condition expression (8), a scatter diagram of "ratio of change in bone dry basis weight before and after grade change vs. errors in predicted steam pressure" and a scatter diagram of "ratio of change in machine speed before and after grade change vs. errors in predicted steam pressure" are created. Then, the slopes of regression lines in these scatter diagrams are determined using the least squares method.

Given that $$Y(i) = (\text{Predicted pre-dryer steam pressure}(i)) - \text{Stable}\,P(i)$$

$$X_1(i) = \frac{(\text{Bone dry basis weight after grade change}(i)) - (\text{Bone dry basis weight before grade change}(i))}{(\text{Bone dry basis weight before grade change}(i))}$$

$$X_2(i) = \frac{(\text{Machine speed after grade change}(i)) - (\text{Machine speed before grade change}(i))}{(\text{Machine speed before grade change}(i))}$$

then, the slopes $K_1$ and $K_2$ of the regression lines are given by $$K_j = \frac{\sum_{i=1}^{NGC2} X_j(i) \times Y(i)}{\sum_{i=1}^{NGC2} X_j(i)^2} \quad (j = 1, 2) \tag{9}$$

These slopes $K_1$ and $K_2$ are used to tune parameters $A_1$ and $A_2$, where parameter $A_1$ is tuned using slope $K_1$ and parameter $A_2$ is tuned using slope $K_2$. Since parameters $A_1$ and $A_2$ are tuned using the same method, the method is explained only once here assuming j=1 and 2.

If the absolute value of $K_R$ is smaller than the prescribed threshold, parameter tuning is not performed in order to avoid excessive tuning. If the absolute value is greater than the threshold, parameter $A_j$ is increased by the amount indicated by equation (10) below.

$$\text{Increment} = F_j \times K_j / PG \tag{10}$$

PG in this equation denotes an increment as the result of predictive steam pressure calculation when the moisture percentage (MP) at the dryer part inlet increases by 1%, and has the unit of kPa/%. $F_j$ is a weight factor and also represents an error (kPa) in the value of steam pressure predicted in relation to the ratio of change in the bone dry basis weight before and after grade change. Therefore, $F_j=-1$ holds true in theory. In order to avoid possible drastic parameter tuning, however, $F_j$ is adjusted to a value that satisfies $-1 \leqq F_j \leqq 0$. In addition, in order to prevent optimization tuning from resulting in divergence, upper and lower limits are set in the results of parameter tuning.

This process can be described in a program format, as shown below.

If $\text{abs}(K_j) \geqq TH_j$ then $$A_{j,\,New} = F_j \times K_j / PG + A_{j,\,Old}(\%) \tag{11}$$

If $A_{j,\,New} > AHI_j$ then $A_{j,\,New} = AHI_j$

If $A_{j,\,New} < ALO_j$ then $A_{j,\,New} = ALO_j$ where, PG is an increment as the result of steam pressure prediction, as discussed earlier, and $F_j$ is a weighting factor. $TH_j$ is a threshold and $AHI_j$ and $ALO_j$ are upper and lower limits, respectively. Parameter $A_j$ with a subscript containing the word "New" is a newly calculated value, whereas that with a subscript containing the word "Old" is a previous value. PG, $F_j$, $TH_j$, $AHI_j$ and $ALO_j$ are set from the screen of a control unit in the paper machine.

Assume that in the aforementioned method of tuning parameters $A_1$ and $A_2$, predictive steam pressure calculation tends to result in excessively small values ($K_1<0$) in the case of grade change involving basis weight increase and, therefore, $A_1$ is increased. Then, the predicted value of steam pressure tends to become large in the case of grade change involving large changes in the basis weight and production volume. Consequently, parameter $A_3$, which affects the results of steam pressure prediction in grade change involving large production volume changes, must be tuned once again.

For this reason, an increment as the result of predicting the dry-bulb temperature of air within a hood when the press outlet moisture percentage (MP) is increased by 1% is defined as $F_{AIR}$, and parameter $A_3$ is increased by a value obtained by multiplying the increment of parameter $A_1$ by $F_{AIR}$.

Under normal conditions, $F_{AIR}$ is set to a value that satisfies $0.0<F_{AIR}<1.0$. Note that specific upper and lower limits are provided so that parameter $A_3$ will not diverge.

This process can be described in a program format, as shown below.

$$A_{3,\,New} = F_{AIR} \times (A_{1,\,New} - A_{1,\,Old}) + A_{3,\,Old} \tag{12}$$

If $A_{3,\,New} > AHI_3$ then $A_{3,\,New} = AHI_3$

If $A_{3,\,New} > ALO_3$ then $A_{3,\,New} = ALO_3$ where, $AHI_3$ and $ALO_3$ are the upper and lower limits of parameter $A_3$, respectively. Parameters $A_1$ and $A_3$ with a subscript containing the word "New" are a newly calculated value, whereas those with a subscript containing the word "Old" are a previous value. $F_{AIR}$, $AHI_3$ and $ALO_3$ are set from the screen of a control unit in the paper machine.

Figure 3:
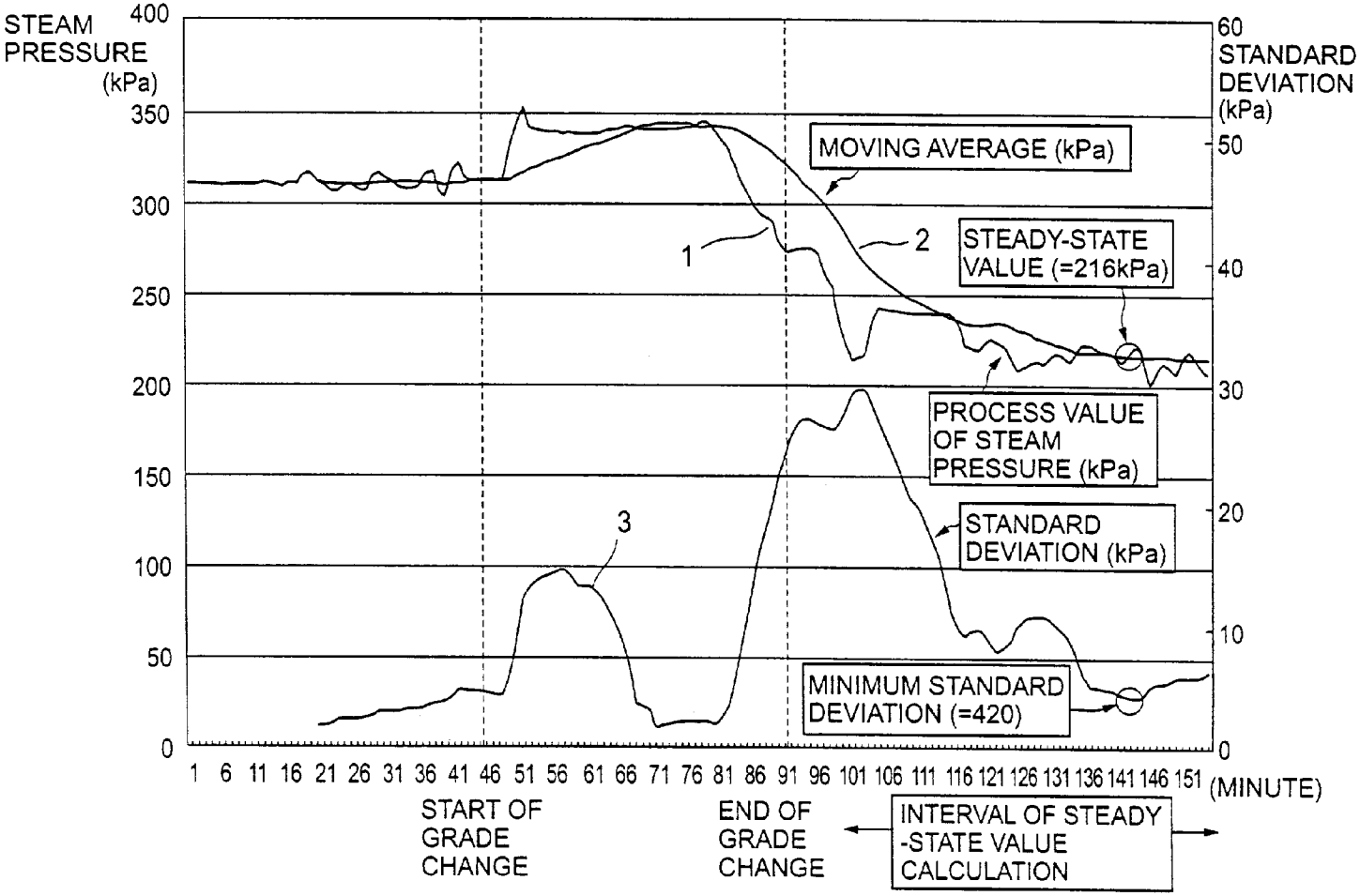
FIG. 3 is a characteristic graph used to calculate the steady-state value of steam pressure.

FIG. 3 is a graph showing the results of automatically calculating the steady-state values of steam pressure (StableP). In this figure, the horizontal axis represents time and the vertical axis represents steam pressure and the standard deviation thereof. The trace indicated by 1 denotes the process value of steam pressure (kPa), the trace indicated by 2 denotes the moving average of process values, and the trace indicated by 3 denotes the standard deviation. Note that the moving-average time AveTime is set to 10 minutes in this graph.

Grade change begins at the time point of 45.5 minutes and ends at the time point of 92 minutes. Steam pressure 1 begins to change dramatically at the time point of approximately 81 minutes, causing standard deviation 3 to increase. This change in steam pressure 1 begins to diminish at the time point of approximately 105 minutes, causing standard deviation 3 to also decrease as the change becomes smaller.

At the time point of 144.5 minutes, when 52.2 minutes have elapsed since the end of grade change, standard deviation 3 reaches its minimum value (4.20). Since the-moving average 2 of steam pressure at this point is 216 kPa, this value is used as the steady-state steam pressure StableP. This result almost perfectly agrees with the value visually read from the graph.

Note that the interval from the time point of 101 minutes to the time point of 155 minutes is defined as the steady-state value calculation interval. In practice, the standard deviation is calculated only in this interval, though in FIG. 3, it is calculated from the beginning for the sake of better understanding. In addition, the steady-state value calculation interval can be any time frame within which the minimum standard deviation can be fixed.

As explained with reference to equation (7) above, parameter $A_3$ for the auto-tuning of the dry-bulb temperature of air within a hood—i.e., parameter $A_3$ in equation (2) discussed earlier—can be determined from the slope of a regression line obtained by assuming that the ratio of a difference in the production volume before and after grade change is X and a difference between the predicted value of pre-dryer steam pressure and the value of the steady-state steam pressure StableP evaluated from FIG. 3 is Y.

Figure 4:
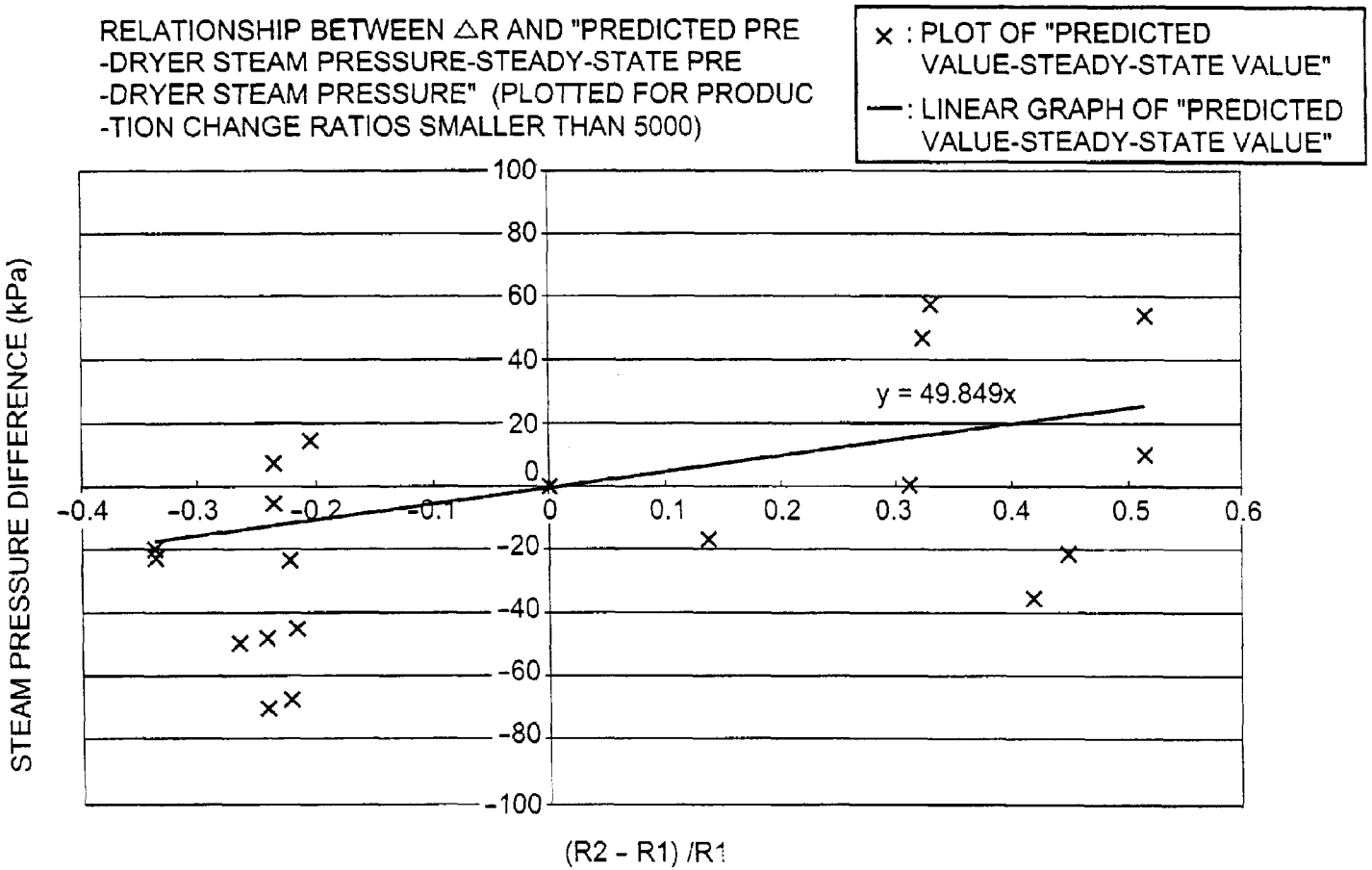
FIG. 4 is a graph showing an example of a regression line.

FIG. 4 is a graph showing such a regression line as mentioned above. The horizontal axis of FIG. 4 represents the ratio of change in the production volume before and after grade change and the vertical axis represents a difference between the predicted value of pre-dryer steam pressure and the value of the steady-state steam pressure StableP. Twenty X's in the graph are plots of data acquired for the values of the production volume change ratio ΔRAna no smaller than 5000.

The upward-sloping straight line in the figure is the regression line obtained by calculation using equation (6). In this example, the slope $K_R$ is calculated to be 49.849. Assuming weighting factor $F_{A3}$=0.012 and the previous value $A_{3,\ Old}$ of parameter $A_3$=0.00, then the new value $A_{3,\ New}$ of parameter $A_3$=0.60 holds true from equation (7).

As discussed with reference to equation (11), parameter $A_1$ used to calculate the initial value of web moisture percentage (MP) shown in equation (1) can be determined from the slope of a regression line obtained by assuming that the ratio of a difference in the bone dry basis weight before and after grade change is X and a difference between the predicted value of pre-dryer steam pressure and the value of the steady-state steam pressure StableP is Y.

Figure 5:
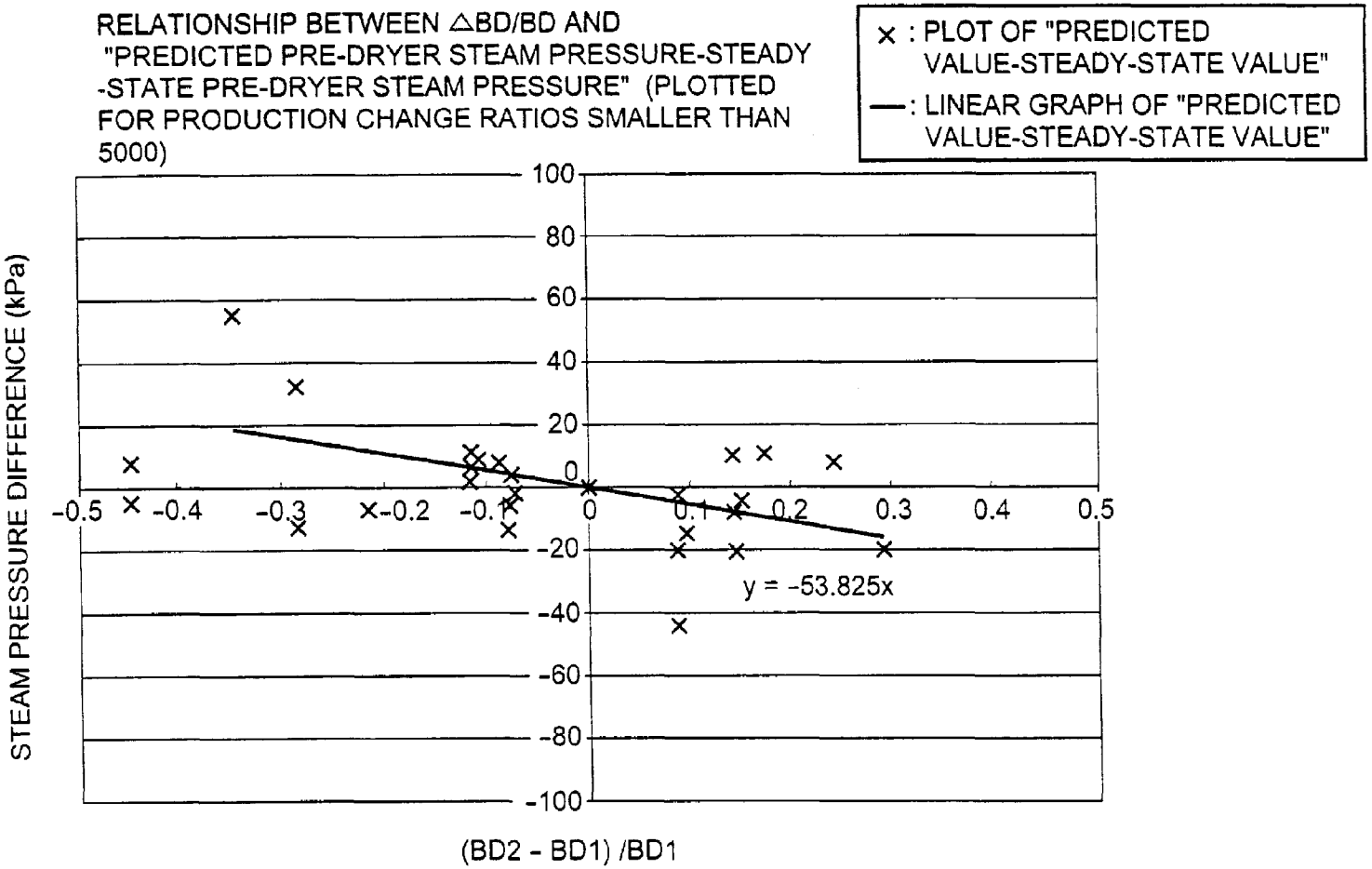
FIG. 5 is a graph showing another example of a regression line.

FIG. 5 is a graph showing such a regression line as mentioned above. The horizontal axis of FIG. 5 represents the ratio of difference in the bone dry basis weight and the vertical axis represents a difference between the predicted and steady-state values of steam pressure. X's in the graph are plots of data acquired for the values of the production volume change ratio $_{\Delta}$RAna smaller than 5000. The downward-sloping straight line in the figure is the regression line obtained from the data. In this example, the slope $K_1$ is calculated to be −53.825.

In equation (11), assume that the increment PG as the result of steam pressure prediction=11 (kPa/%), weighting factor $F_1$=0.9, and the previous value $A_{1,\ Old}$ of parameter $A_1$=8.70 (%). Then, the new value $A_{1,\ New}$ of parameter $A_1$=8.70+4.40=13.1 (%) holds true.

Also assume that the increment $F_{AIR}$ as the result of predicting the dry-bulb temperature of air within a hood=0.03 and the previous value $A_{3,\ Old}$ of parameter $A_3$=0.60. Then, the new value $A_{3,\ New}$ of parameter $A_3$=0.03×4.40+0.60=0.73 holds true.

Figure 6:
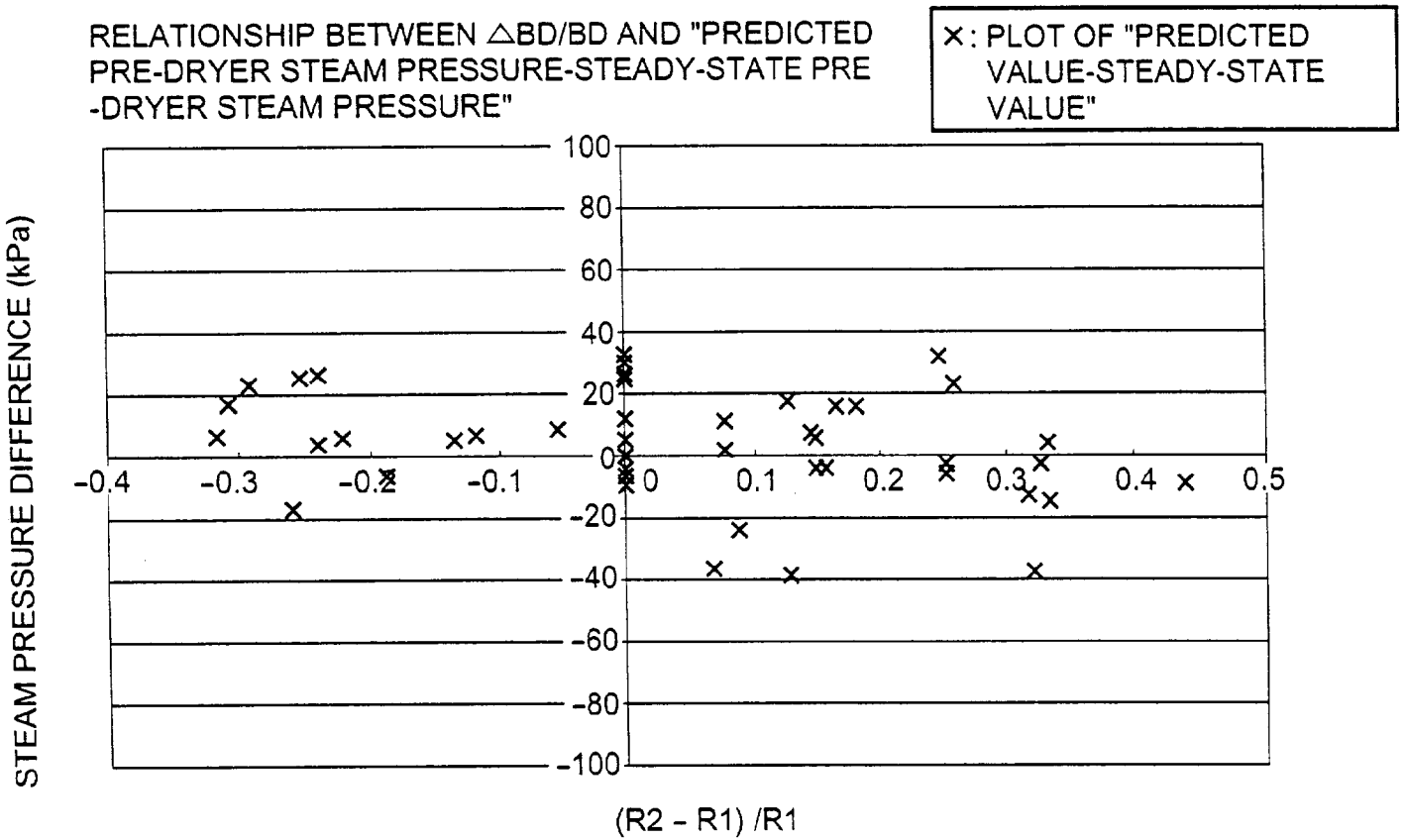
FIG. 6 is a graph showing the advantageous effect of the present invention.

FIG. 6 is a graph showing the dispersion of differences between the predicted values of pre-dryer steam pressure calculated by using parameters $A_1$ to $A_3$ determined from equations (7), (11) and (12) and the values of the steady-state steam pressure StableP. The horizontal axis of FIG. 6 represents the ratio of difference in the production volume before and after grade change and the vertical axis represents a difference between the predicted value of pre-dryer steam pressure and the value of the steady-state steam pressure StableP.

X's in the graph are plots of data acquired for each case of grade change. Note that the aforementioned data has been acquired for all instances of grade change, irrespective of the amount of change in the production volume. The differences between the predicted values and steady-state values are smaller than 40 kPa in all instances of grade change, indicating that the method in accordance with the present invention is effective.

Figure 7:
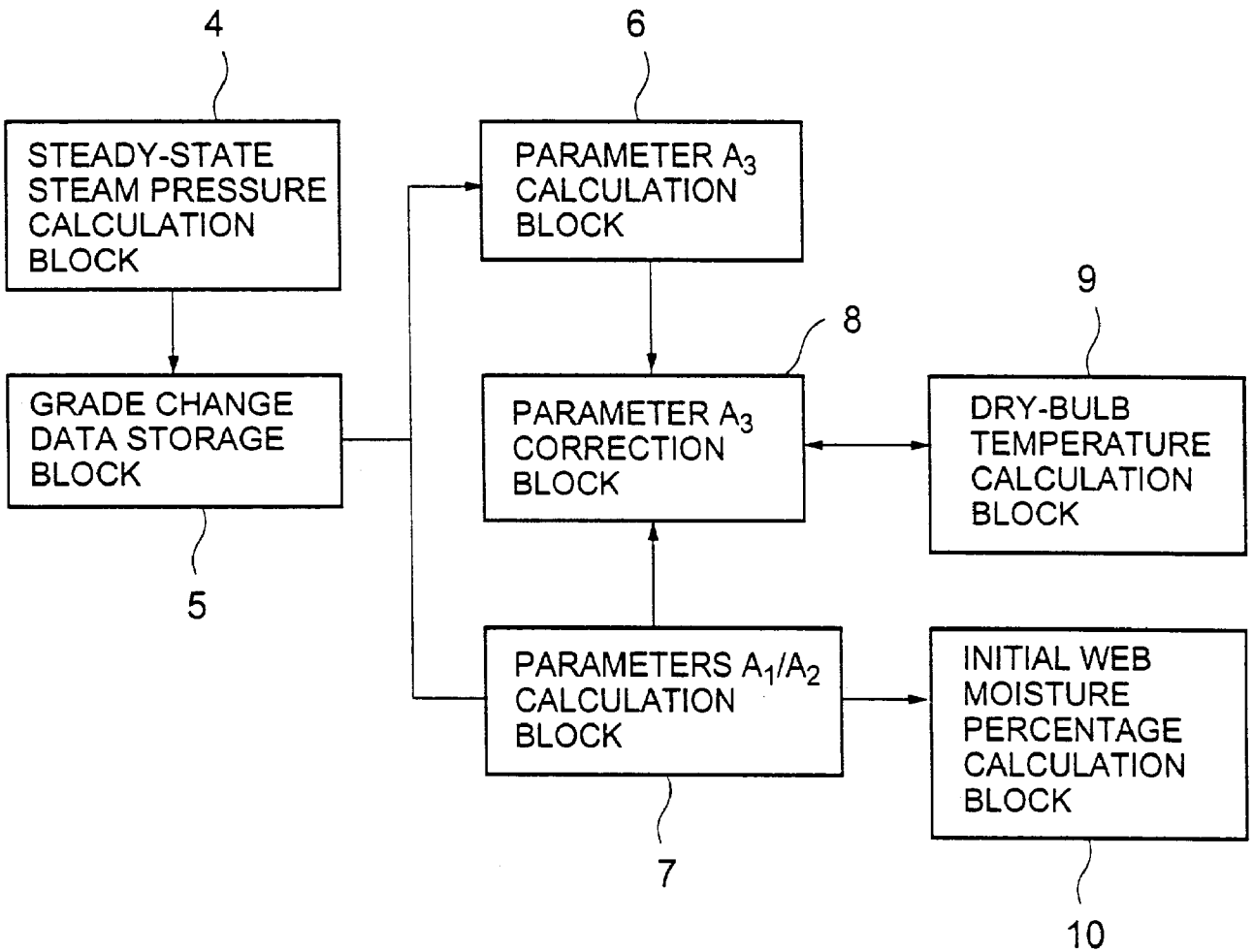
FIG. 7 is a block diagram showing one embodiment of the present invention.

FIG. 7 is a block diagram showing one embodiment of apparatus for predictive dryer control in a paper machine in accordance with the present invention. In FIG. 7, numeral 4 denotes a steady-state steam pressure calculation block, whereby the steady-state value of steam pressure is calculated and fixed from changes in the standard deviation of steam pressure process values, as discussed earlier. Numeral 5 denotes a grade change data storage block wherein the steady-state steam pressure values calculated by steady-state steam pressure calculation block 4 and other-point-of-grade-change data are stored.

Numeral 6 denotes a parameter $A_3$ calculation block, whereby parameter $A_3$ is calculated according to equation (7) from point-of-grade-change data stored in grade change data storage block 5, and tuned. Numeral 7 denotes a parameter $A_1/A_2$ calculation block, whereby parameters $A_1$ and $A_2$ are calculated according to equation (11) from point-of-grade-change data stored in grade change data storage block 5, and tuned.

Numeral 8 denotes a parameter $A_3$ correction block, which receives parameter $A_1$ from parameters $A_1/A_2$ calculation block 7 to correct the parameter according to equation (12). Numeral 9 denotes a dry-bulb temperature calculation block, which receives parameter $A_3$ from parameter $A_3$ correction block 8 to calculate the dry-bulb temperature of air within a hood according to equation (2). Numeral 10 denotes an initial web moisture percentage (MP) calculation block, which receives parameters $A_1$ and $A_2$ from parameters $A_1/A_2$ calculation block 7 to calculate the initial value of web moisture percentage according to equation (1).

Note that parameter $A_3$ correction block 8 is unnecessary if parameters $A_1$ and $A_2$ need not be tuned. In this case, the output of parameter $A_3$ calculation block 6 is supplied to dry-bulb temperature calculation block 9 to calculate the dry-bulb temperature.

What is claimed is:

1. A method of predictive dryer control in a paper machine, comprising the steps of:

determining an initial value of web moisture percentage at a dryer part inlet after grade change by obtaining a sum of a first value obtained by multiplying a first ratio of a difference in bone dry basis weight before and after grade change by a first parameter, and a second value obtained by multiplying a second ratio of a difference in machine speed before and after grade change by a second parameter;

determining a regression line correlating a ratio of a difference in bone dry basis weight before and after grade change with a difference between a predicted value and a steady state value of steam pressure; and calculating one of said first and second parameters from a slope of said regression line.

2. The method of claim 1, wherein a plurality of earlier point of grade change data items are used to determine said regression line, said items comprising data of grade change where an absolute value of a ratio of production volume change is smaller than a prescribed value and absolute value of said first ratio is larger than a prescribed value.

3. The method of claim 1, wherein said first parameter is calculated from a slope of said regression line.

4. The method of claim 3, wherein said first parameter is calculated according to the following equation:

$$\text{Current value of said first parameter} = F_1 \times K_1 / PG + \text{Previous value of said first parameter},$$

wherein $F_1$ is a weighting factor, $K_1$ is a slope of a regression line correlating ratio of a difference in bone dry basis weight before and after grade change with a difference between predicted value and steady state value of steam pressure, and PG is an increment as result of predicting steam pressure for an increase in web moisture percentage at a dryer part inlet.

5. The method of claim 4, wherein calculation of said first parameter is executed only when an absolute value of a slope of said regression line is greater than a prescribed value.

6. The method of claim 4, wherein said weighting factor $F_1$ satisfies the following: $-1 \leqq F_1 < 0$.

7. The method of claim 4, wherein upper and lower limits are set in a calculated result of said first parameter.

8. The method of claim 1, wherein said second parameter is calculated from a slope of said regression line.

9. The method of claim 8, wherein said second parameter is calculated according to the following equation:

$$\text{Current value of said second parameter} = F_2 \times K_2 / PG + \text{previous value of said second parameter},$$

wherein $F_2$ is a weighting factor, $K_2$ is a slope of a regression line correlating ratio of a difference in bone dry basis weight before and after grade change with a difference between predicted vaue and steady state value of steam pressure, and PG is an increment as result of predicting steam pressure for an increase in web moisture percentage at a dryer part inlet.

10. The method of claim 9, wherein calculation of said second parameter is executed only when absolute value of a slope of said regression line is greater than a prescribed value.

11. The method of claim 9, wherein said weighting factor $F_2$ satisfies the following: $-1 \leqq F_2 < 0$.

12. The method of claim 9, wherein upper and lower limits are set in a calculated result of said second parameter.

13. The method of claim 1, comprising the further steps of:

determining dry bulb temperature of air within a hood from a value obtained by multiplying an increment in steam temperature within a drum by a third parameter;

determining another regression line correlating ratio of a difference in production volume before and after grade change with a difference between a predicted value and a steady state value of steam pressure;

calculating said third parameter from a slope of said another regression line; and correcting said third parameter by using a difference between a current value of said first parameter and previous value of said first parameter.

14. The method of claim 13, wherein upper and lower limits are set when said third parameter is corrected.

15. The method of claim 13, wherein said steady state value of steam pressure is a measured value of steam pressure when a standard deviation is minimum, said standard deviation being determined for a given time period with regard to a measure value of steam pressure after grade change.

16. The method of claim 15, wherein said steady state value of steam pressure is set to 0 when minimum value of said standard deviation is greater than a prescribed value.

17. A method of predictive dryer control in a paper machine, comprising the steps of:

determining dry bulb temperature of air within a hood after grade change from a value obtained by multiplying an increment in steam temperature within a drum by a particular parameter;

determining a regression line correlating ratio of a difference in production volume before and after grade change with difference between a predicted value and a steady state value of steam pressure; and calculating said particular parameter from a slope of said regression line.

18. The method of claim 17, wherein a plurality of earlier point of grade change data items are used to determine said regression line, said items comprising data of grade change where an absolute value of ratio of production volume change is smaller than a prescribed value and an absolute value of ratio of bone dry basis weight change is larger than a prescribed value.

19. The method of claim 17, wherein said particular parameter is calculated according to the following equation:

$$\text{Current value of said particular parameter} = F_{A3} \times K_R + \text{previous value of said particular parameter},$$

wherein $FA_{A3}$ is a weighting factor, and $K_R$ is slope of a regression line correlating ratio of a difference in production volume before and after grade change with a difference between predicted value and steady state value of steam pressure.

20. The method of claim 17, wherein calculation of said particular parameter is executed only when an absolute value of a slope of said regression line is greater than a prescribed value.

21. The method of claim 17, wherein said weighting factor $F_{A3}$ has a positive value.

22. The method of claim 17, wherein upper and lower limits are set in a calculated result of said particular parameter.

23. An apparatus for predictive dryer control in a paper machine, said apparatus comprising:

first means for calculating and outputting steady state value of steam pressure;

second means for storing output from said first means and for storing point of grade change data;

third means for calculating first and second parameter used to calculate an initial value of web moisture percentage from a ratio of a difference in bone dry basis weight before and after grade change and ratio of a difference in machine speed before and after grade change; and fourth means for calculating an initial value of web moisture percentage using said first and second parameters calculated by said third means.

24. The apparatus of claim 23, further comprising:

fifth means for calculating a third parameter used to calculate dry bulb temperatue of air within a hood from an increment in steam temperature within a drum; and sixth means for calculating dry bulb temperature of air within said hood using said third parameter.

25. An apparatus for predictive dryer control in a paper machine, said apparatus comprising:

first means for calculating and outputting steady state value of steam pressure;

second means for storing output from said first means and for storing point of grade change data;

third means for calculating a particular parameter used to calculate a dry bulb temperature of air within a hood from an increment in steam temperature within a drum; and fourth means for calculating dry bulb temperature of air within said hood using said particular parameter calculated by said third means.

* * * * *